US006931733B2

(12) United States Patent
Lin

(10) Patent No.: US 6,931,733 B2
(45) Date of Patent: Aug. 23, 2005

(54) CARPENTER'S COMBINATION PLANE

(76) Inventor: Kun-Meng Lin, No. 44-17, Han Nan Street, Wen Te Village, Hua Tan Hsiang, Chang Hua Hsien (TW)

( * ) Notice: Subject to any disclaimer, the term of this patent is extended or adjusted under 35 U.S.C. 154(b) by 170 days.

(21) Appl. No.: 10/270,226

(22) Filed: Oct. 15, 2002

(65) Prior Publication Data

US 2004/0068878 A1 Apr. 15, 2004

(51) Int. Cl.[7] ..... B27G 17/02

(52) U.S. Cl. ..... 30/478; 30/123; 30/489; 30/492; 30/491; 7/158

(58) Field of Search ..... 30/478, 123, 489, 30/492, 491; 7/158; 451/461

(56) References Cited

U.S. PATENT DOCUMENTS 869,016 A * 10/1907 Petrusich ..... 30/478
915,746 A * 3/1909 Delsee ..... 451/358
1,202,256 A * 10/1916 Young ..... 30/489
1,951,452 A * 3/1934 Stevens ..... 30/478
2,400,929 A * 5/1946 Hein ..... 451/522
2,781,804 A * 2/1957 Wilson et al. ..... 30/478
3,027,641 A * 4/1962 Leonardson ..... 30/329
4,221,084 A * 9/1980 Frantzen ..... 451/503
4,373,628 A * 2/1983 Dantes ..... 206/349
4,589,209 A * 5/1986 Zarges et al. ..... 30/478
6,205,668 B1 * 3/2001 Fournier, Jr. ..... 30/478
6,626,744 B1 * 9/2003 White et al. ..... 451/66
2003/0037446 A1 * 2/2003 Saunders et al. ..... 30/481

* cited by examiner

*Primary Examiner*—Charles Goodman
(74) *Attorney, Agent, or Firm*—Charles E. Baxley

(57) ABSTRACT

A carpenter's combination plane comprised of a basic holder and a blade holder, adapted with various holder accessories depending on the size of the work surface and the distance of reciprocal planing; other auxiliary accessories may be provided to the holder accessories to define the width, depth, inclined surface of the work surface or the polishing work surface.

3 Claims, 11 Drawing Sheets

CARPENTER'S COMBINATION PLANE

BACKGROUND OF THE INVENTION (a) Field of the Invention

The present invention is related to a carpenter's combination plane blade, and more particularly to one blade combined with multiple accessories.

(b) Description of the Prior Art

A carpenter's plane blade is always needed in manual plane on wooden materials, and proper plane blade together with accessories is selected depending on a work plane. Generally, the work plane varies according to changes in its area, angle, arc, slippage, weak joint depth and width . . . etc. To help efforts saving, fast and perfect plane work, selection of proper plane blade and its accessories is crucial.

SUMMARY OF THE INVENTION

The primary purpose of the present invention is to provide a carpenter's combination plane that allows the selection of using the carpenter's plane blade alone or adapted with accessories depending on the size of the work plane and the distance of reciprocal plane.

The secondary purpose of the present invention is to provide a carpenter's combination plane that is adapted with other auxiliary accessories to the existing ones to define width, depth and inclination of the work plane, or the work surface for polishing.

The third purpose of the present invention is to provide a carpenter's combination plane that permits easy and fast replacement of a carpenter's plane blade to cope with the individual job requirements.

The fourth purpose of the present invention is to provide a carpenter's combination plane that allows easy, fast and convenient mounting or removal of accessories with bare hands.

To achieve those purposes, the present invention is comprised of a basic holder, a blade holder and a holder accessory. Wherein, the basic holder includes a handle and a slope extending outward and downward from the lower edge in the front of the handle; and an accommodation space for the blade holder is defined between where below the slope and the handle.

The blade holder provided with a structure to receive insertion of a blade is fixed and the blade is restricted by and the blade edge normally exposed from the blade holder and the slope.

The accessories provided on the slope are available with a short holder, a standard holder and a long holder. The standard holder may be further adapted with a width positioning plate, a depth positioning plate or a sandpaper holder.

DETAILED DESCRIPTION OF THE PREFERRED EMBODIMENTS

A preferred embodiment of the present invention is essentially comprised of a basic holder (10) and a blade holder (14).

Figure 1A:
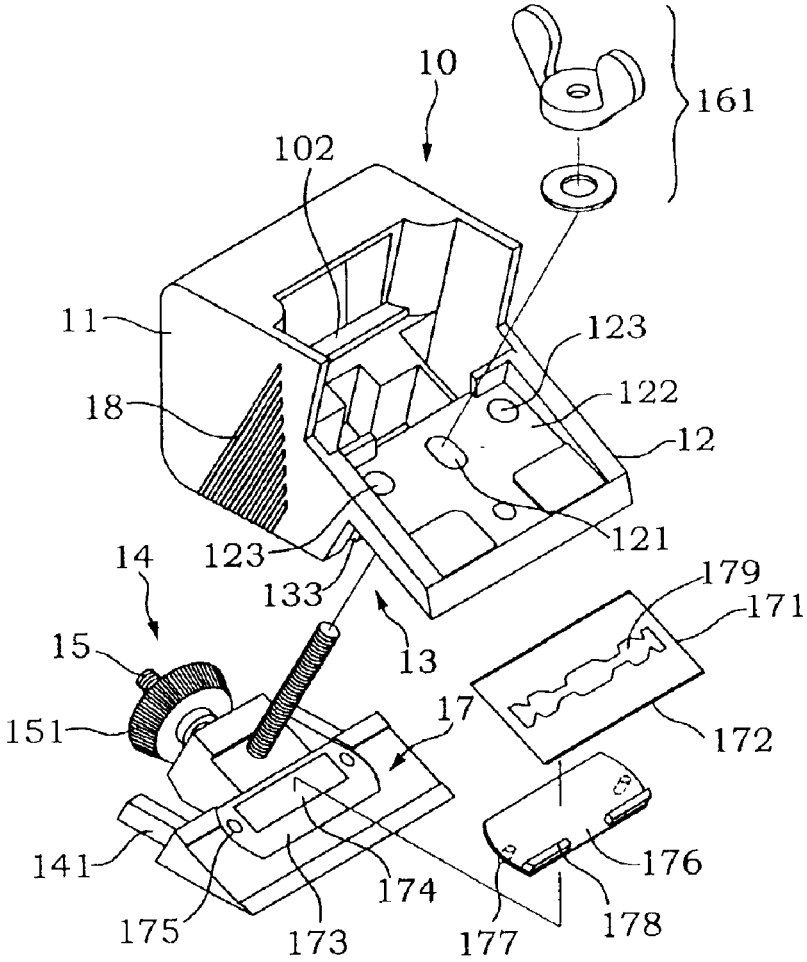
FIG. 1A is an exploded view of a basic holder and a blade holder of a preferred embodiment of the present invention.
Figure 1B:
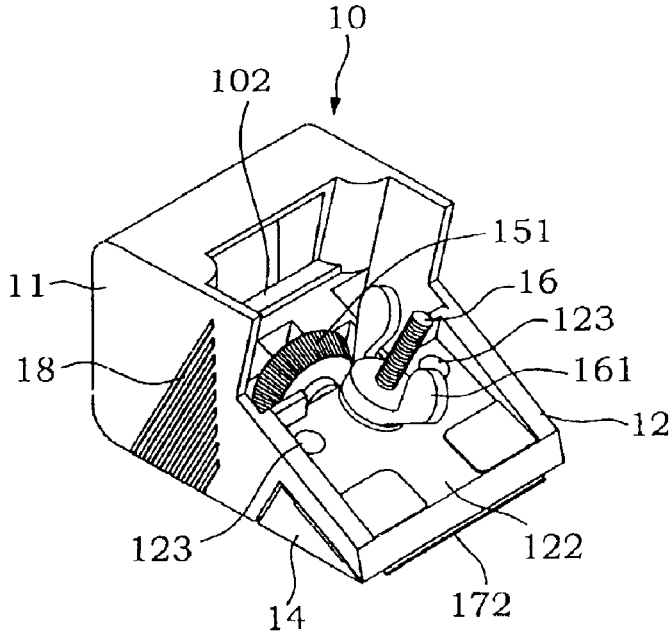
FIG. 1B is a view of an assembly of the basic holder and the blade holder of the preferred embodiment of the present invention taken from FIG. 1.

Referring to FIGS. 1A and 1B, the basic holder (10) includes a hollow, substantially rectangular handle (11) and a slope (12) extending outward and downward at an inclination from the lower edge in front of the handle (11). Wherein, a space (13) to accommodate the blade holder (14) with its section indicating a triangle is formed between where below the slope (12) and the handle (11). A rectangular pivoting hole (121), a pivoting channel (122) settled to the upper surface of the slope (12) and two positioning channels are respectively provided in the slope (12). A bolting hole (132) as illustrated in FIG. 5C with its opening facing downward is provided on a wall erected between the blade holder space (13) and the handle (11), and an orientation channel (133) with its opening facing downward is provided on the face on both sides of the handle (11). Furthermore, multiple slip-proof stripes (18) are provided on the external walls on both sides of the handle (11).

The blade holder (14) as illustrated in FIGS. 1A and 1B, with its section of the body substantially indicating a triangle, has provided two bolts (15, 16) respectively at its rear end and at the center of the upper rear end and each bolt (15, 16) is provided with a nut (151, 161) while a rod (141) is each protruding backward on both sides in the rear. A blade insertion structure (17) is disposed at the top of the blade holder (14), wherein, a long insertion slot (173) is provided on the body of the blade holder (14) and a magnet (174) is embedded in the insertion slot (173) and one or more than one positioning hole (175) is respectively provided on both sides of the insertion slot (173). An insertion (176) not subject to force from the magnet (174) is adapted to the insertion slot (173) and has its face secured in place with one or more than one positioning post (177) to penetrate the positioning hole (175). A protrusion bit (178) is provided on the top of the insertion (176) to receive an insertion hole (179) in a blade (171) for the blade (171) to be secured in place by the magnet (174) through the insertion (176). Normally, the blade edge (172) is exposed out of the blade holder (14). The blade insertion structure (17) allows replacement with the insertion (176) and the blade (171) of various forms as required by the job. The blade holder (14) is inserted below and wedged in the blade holder space (13). Wherein, the bolt (16) penetrates through the pivoting hole (121) in the slope (12) while the other bolt (15) penetrates through the bolting hole (132) into the handle (11) together with the nut (151). Those two protruded rods (141) are respectively held in position in the orientation channel (133). Consequently, a back and forth inching adjustment of the blade holder (14) can be achieved by taking advantage of the long pivoting hole (121) and the lateral balance of the blade holder (14), by moving the protruded rod (141) in the orientation channel (133). Then the distance of the blade edge (172) exposed out of the blade holder (14) is determined before tightening up the nut (161) of the bolt (16) at the top of the blade holder (14) to secure the blade holder (14), followed by tightening up the nut (161) in the rear of the blade holder (14) thus to entirely secure the blade holder (14) in the blade holder space (13). Wherein, the blade (171) is restricted between the blade holder (14) and the slope (12) with the blade edge (171) exposed out of the slope (12).

The incorporated basic holder (10) and the blade holder (14) are referred as a basic unit of a plane as illustrated in FIG. 1B. A user holds firmly the handle (11) as aided by the slip-proof stripes (18) provided on both sides of the handle (11) and places the basic unit on a surface of a work piece. An angle is respectively formed between the blade (171) with its blade edge (172) as well as and the face of the basic unit and the surface of the work piece to plane the surface of the work piece by reciprocally moving back and forth of the basic unit. To this inventor, the optimal application of the basic unit of the plane is to have the blade edge (172) to remove any foreign matter, namely, consolidated glue or paint spots left on the smooth surface of brick, slightly protruding from the surface of the work piece.

The basic unit of the plane is further adapted with other accessory holder. The accessory holder may be provided in the form of a standard holder (30), a short holder (20) and a long holder (40) as illustrated in FIGS. 2A through 4B. All those accessory holders share a common feature of having provided at the rear end a pivoting hole (31, 21, 41) to pivot the bolt (16) then tightened up with the nut (161) for the rear of the respectively accessory holder to be secured to the slope (12). A press plate (32, 22, 42) extends at the same level in relation to the blade edge (172). The rear of the press plate (32, 22, 42) is provided away from the blade edge (172) for a certain distance referred as a planing trough (33, 23, 43). Over the planing trough (33, 23, 43) is provided with an opening planing space (34, 24, 44). The face of the rear of the accessory holder (30, 20, 40) is protruding downward a pivoting bit (351, 251, 451) and a positioning stud (352, 252, 452). The pivoting bit (351, 251, 451) is inserted into the pivoting channel (122) of the slope (12) and the positioning stud (352, 252, 452) is inserted into the positioning channel (123) to firmly secure the accessory holder (30, 20, 40).

Furthermore, the short holder (20) has its press plate (22) shorter than that of the standard holder (30) and the long holder (40) has its press plate (42) longer than that of the standard holder (30) with a gripper (46) provided on the upper surface in front of the long holder (40).

Depending on the size of the work area and the work distance of the reciprocal planing operation, a proper combination of the basic unit and the accessory holder is selected. The smaller the work area and planing distance is, the shorter accessory holder, namely, the short holder (20) is desired. On the contrary, the larger the work area and planing distance is, the longer accessory holder, namely, the long holder (40), is desired. If the long holder (40) is selected, it is advised to have one hand to hold the plane and another hand to hold the gripper (46) to guide the planing direction for avoiding possible deflection.

By compressing the press plate (32, 22, 42) and maintaining a lateral force applied to the basic unit of the plane, the inclined blade edge (172) starts to plane the work surface. Resultant planings are squeezed into the planing space (34, 24, 44) with a certain portion of the planings overflowing from the top of the planing space (34, 24, 44), or the user may empty the planings in the accessory holder. All the short holder (20), standard holder (30) and long holder (40) are applicable to plane horizontal surface, and the short holder (20) can be also used in angular planing.

Figure 2A:
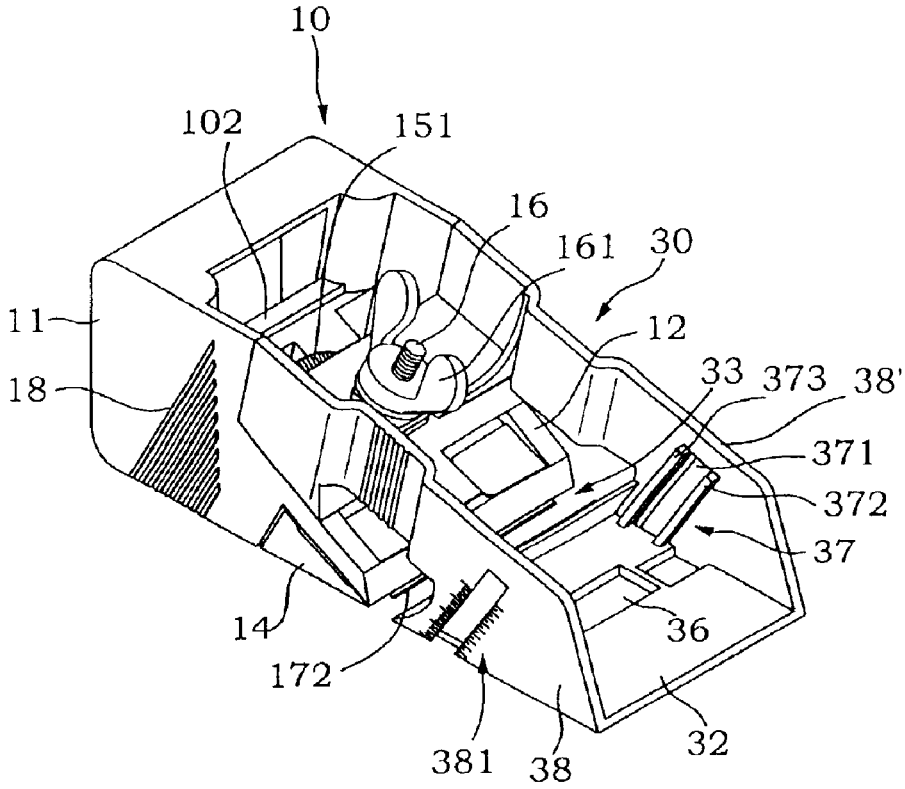
FIG. 2A is a view of the assembly taken from FIG. 1B adapted with a standard holder.
Figure 2B:
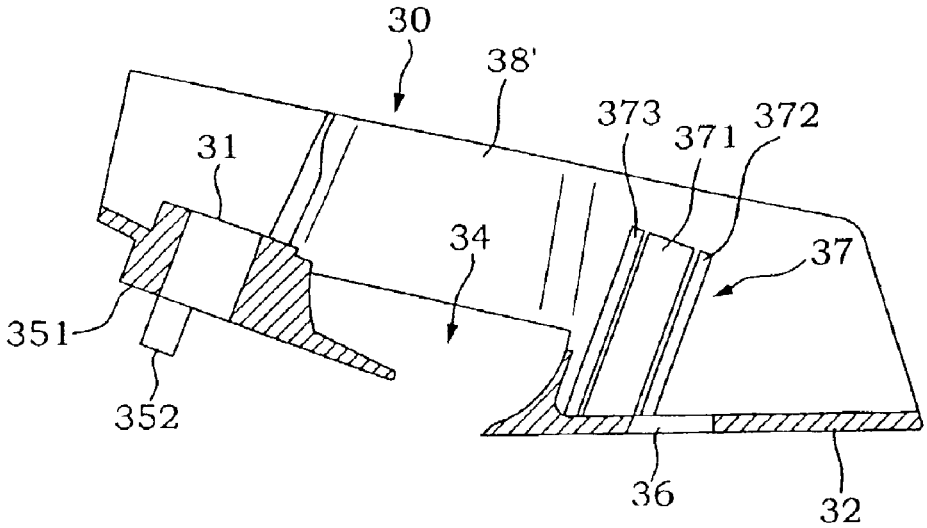
FIG. 2B is a cross sectional view of the standard holder of the preferred embodiment of the present invention.
Figure 3A:
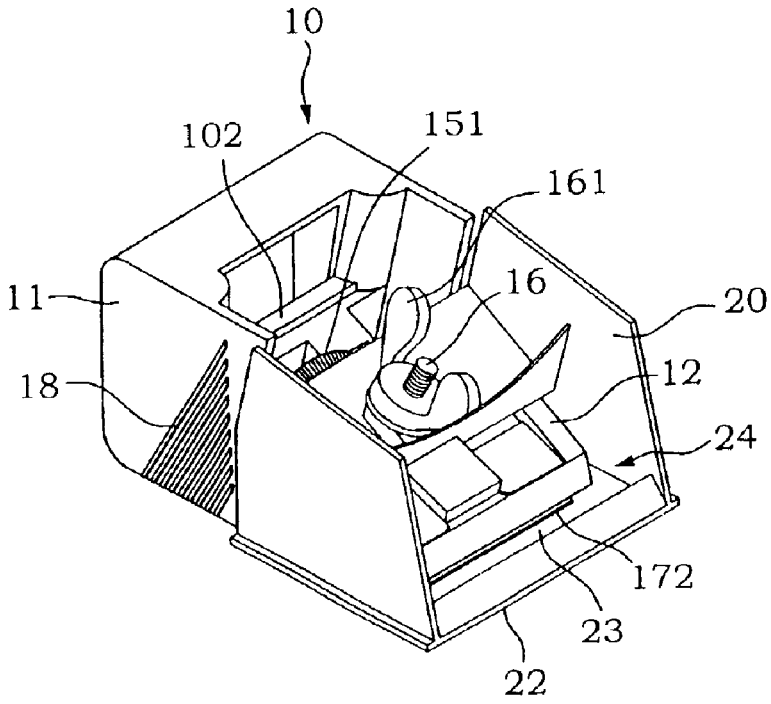
FIG. 3A is a view of the assembly taken from FIG. 1B adapted with a short holder.
Figure 3B:
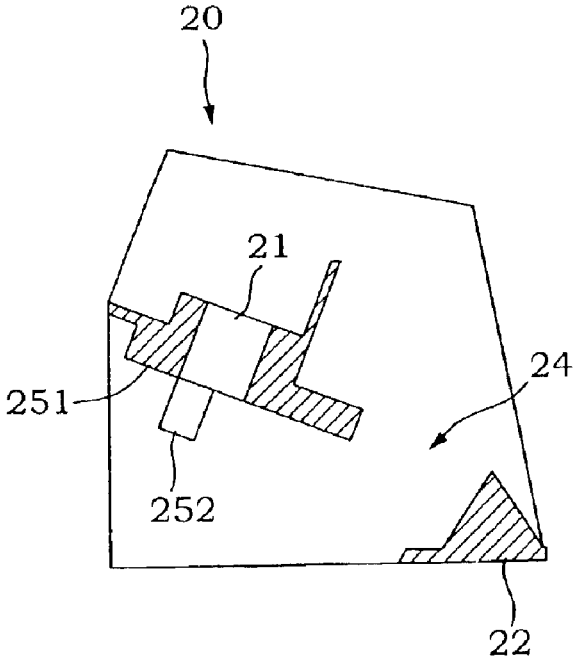
FIG. 3B is a cross sectional view of the short holder of the preferred embodiment of the present invention.
Figure 4A:
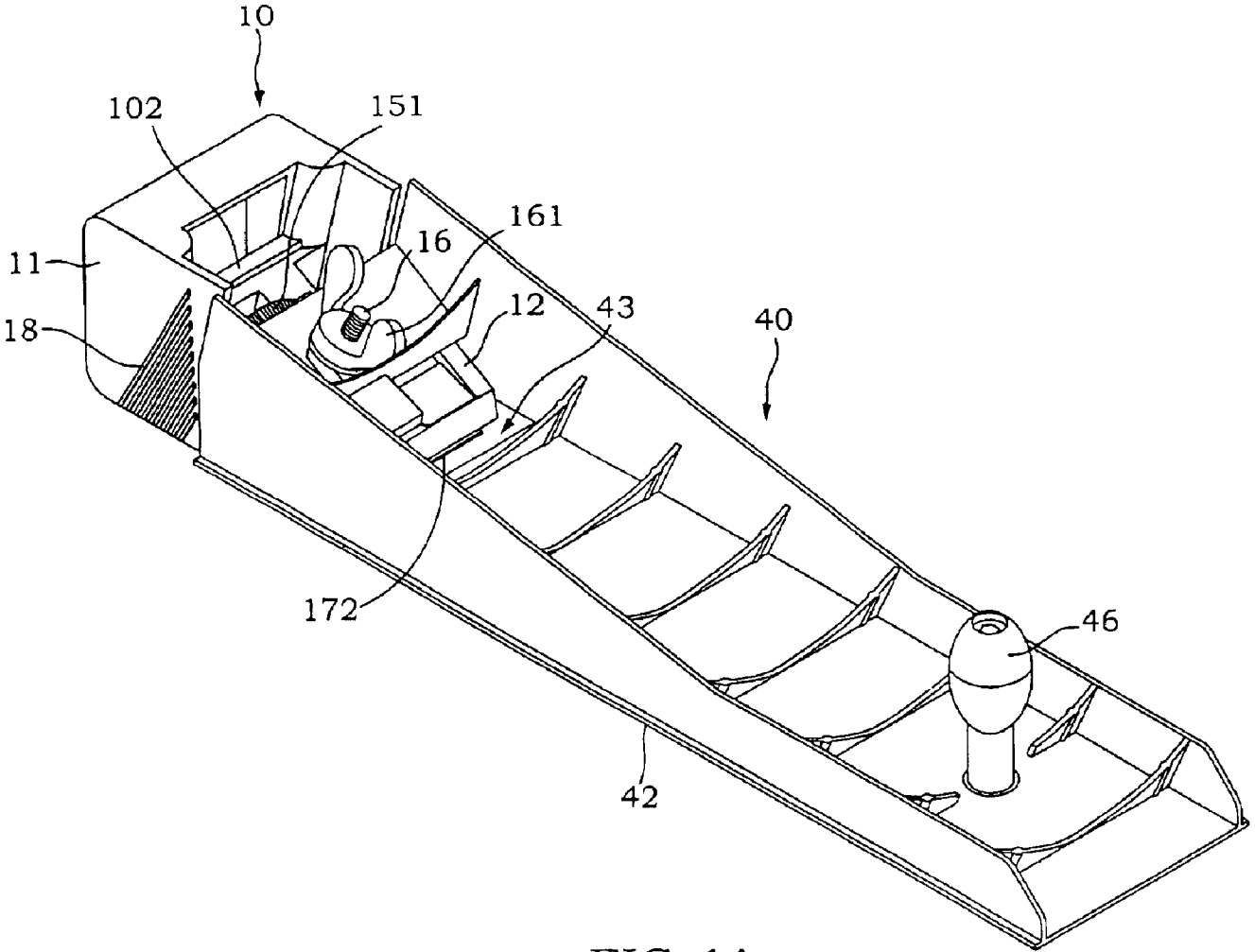
FIG. 4A is a view of the assembly taken from FIG. 1B adapted with a long holder.
Figure 4B:
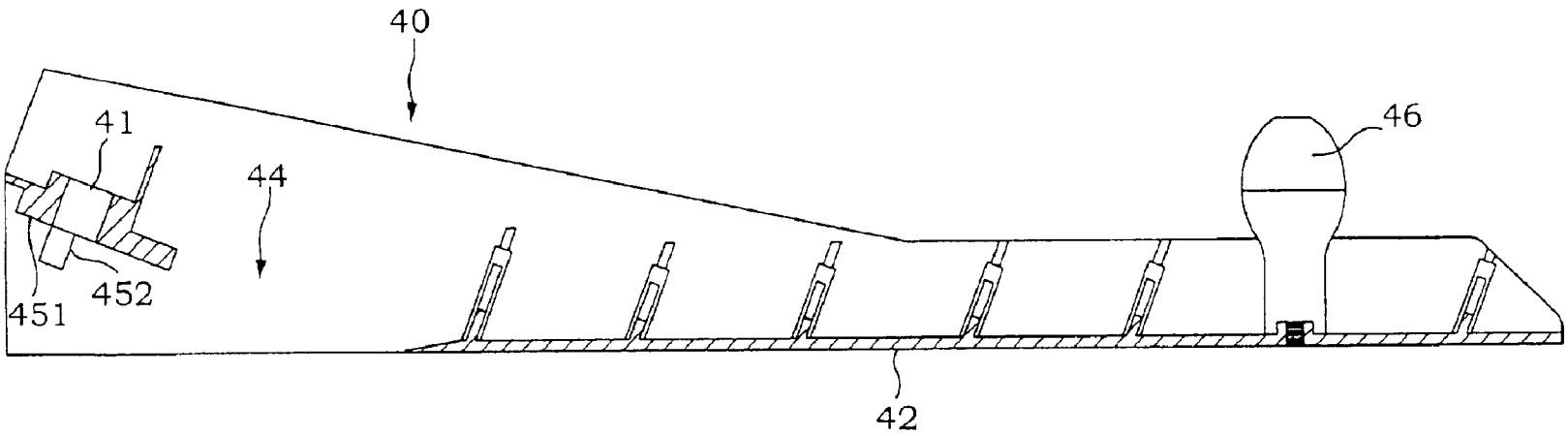
FIG. 4B is a cross sectional view of the long holder of the preferred embodiment of the present invention.

To facilitate the subsequent description, the basic unit of the plane combined with the standard holder is referred to as a standard unit of the plane as illustrated in FIG. 2A. The standard unit of the plane can be further adapted with auxiliary accessories by means a mechanism provided to the standard holder (30) and the mechanism is comprised of a rectangular base channel (36) provided on the press plate (32) at where cutting through vertically with the central axial of the press plate (32); a side slot (37) each provided on the opposite sides of both side walls (38, 38') of the standard holder (30) including a side channel (371) each on the side walls (38, 38'), and a protruded strip (372, 373) each provided on both sides of the side channel (371).

The auxiliary accessories include a width positioning plate (50), a depth positioning plate (60) and a sand paper holder (70).

Figure 6A:
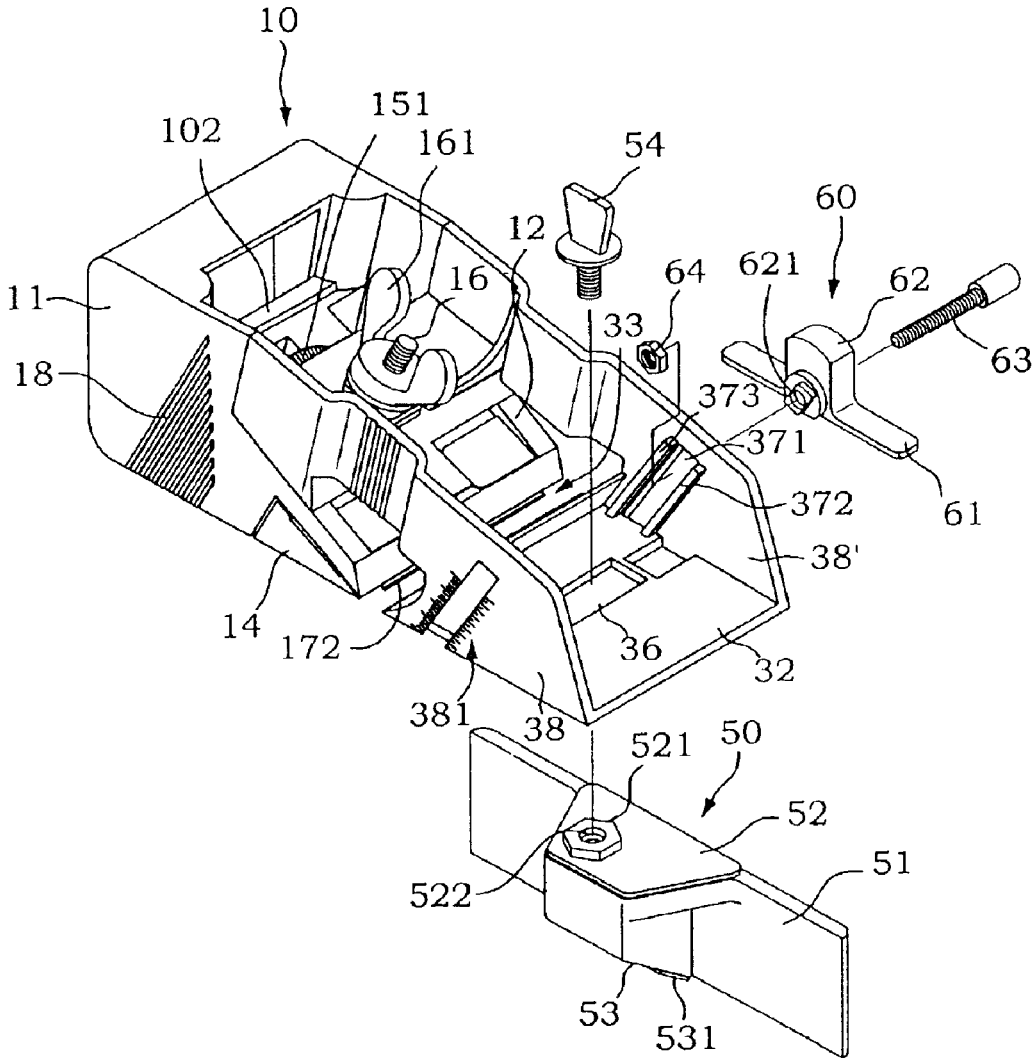
FIG. 6A is an exploded view showing the assembly taken from FIG. 2A, a width positioning plate and a depth positioning plate.
Figure 6B:
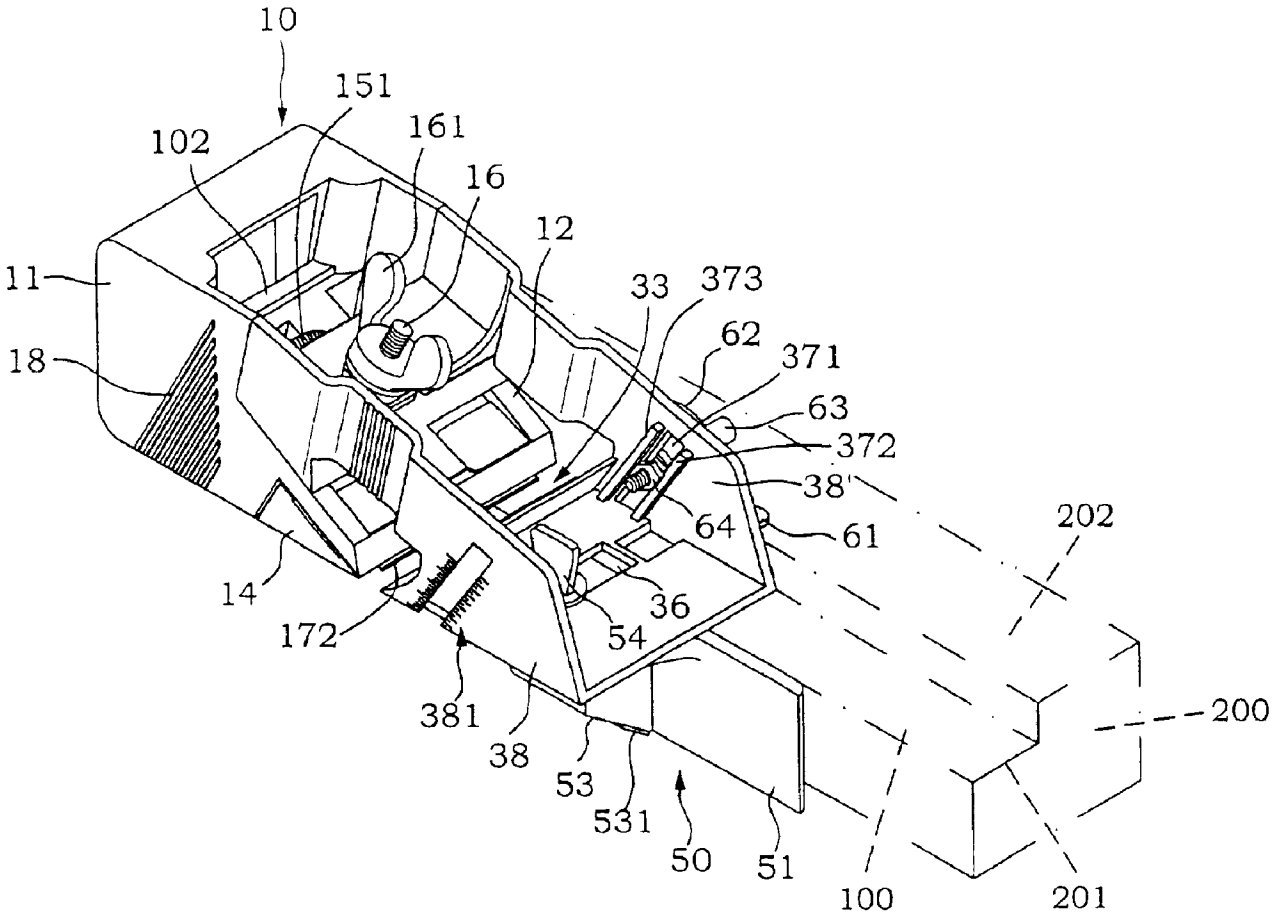
FIG. 6B is a schematic view showing an assembly of FIG. 6A is in use.

As illustrated in FIGS. 6A and 6B, the width positioning plate (50) relates to a flat board (51) having provided on one side a protruded bit, and one side of the protruded bit is a flat surface (52) vertically crossing the flat board (51) while the other surface of the protruded bit in opposite to the flat surface (52) relates to an inclined surface (53) outward provided. An angular bit (521, 531) containing a screw hole (522, 532) is each protruded from the flat surface (52) and the inclined surface (53).

The width positioning plate (50) has its flat surface (52) facing upward and is disposed in the rectangular base channel (36) of the press plate (32) with the angular bit (521), then secured in the lower standard holder (30) with a bolt (54) locked from above into the screw hole (522). The width positioning plate (50) can be adjusted in the rectangular base channel (36) to change the relative distance from the face of the flat board (51) to the side of the standard holder (30) so to define the width of a work surface 100).

Figure 7A:
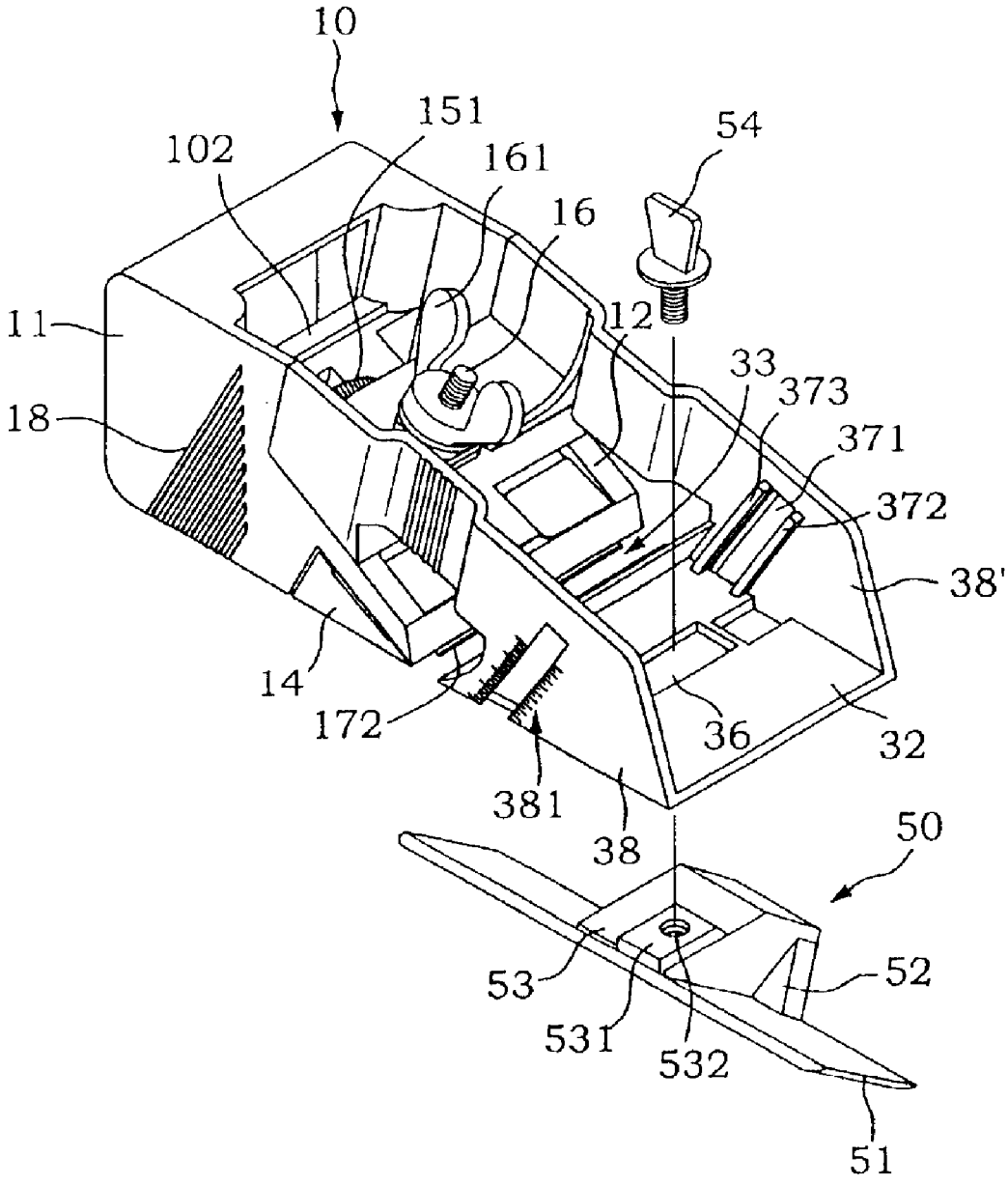
FIG. 7A is an exploded view showing the assembly taken from FIG. 2A and an inclination positioning plate.
Figure 7B:
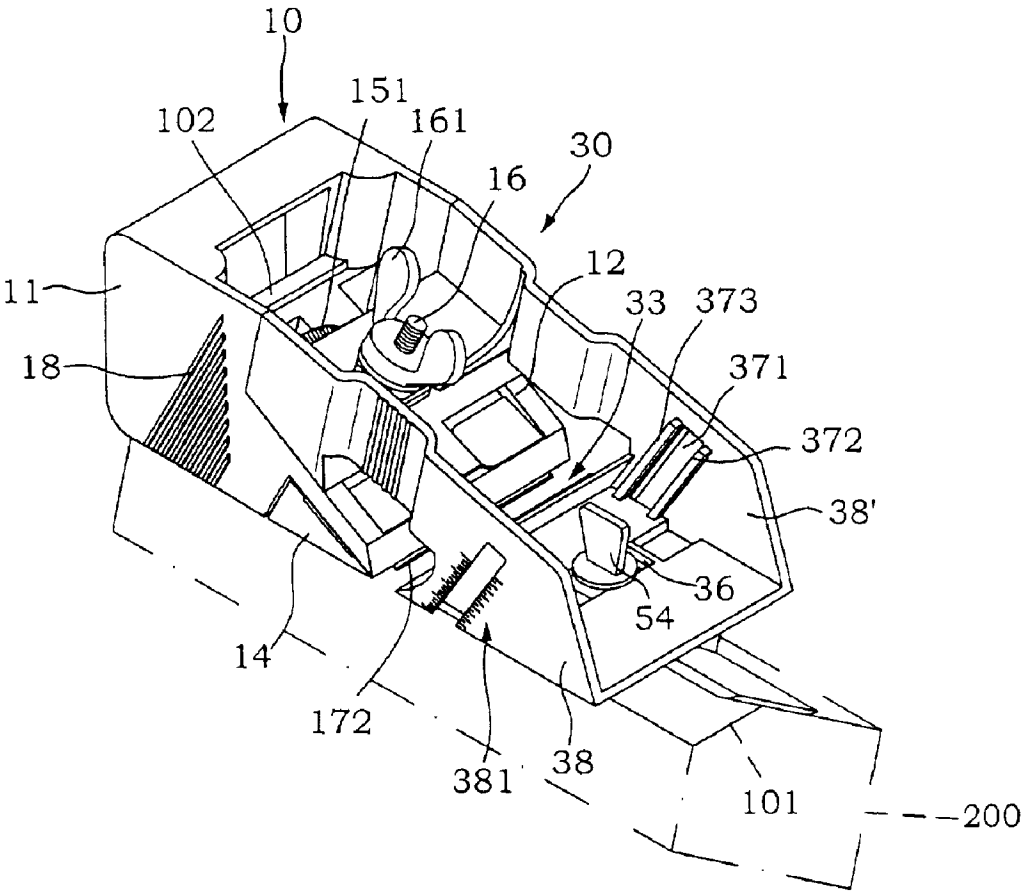
FIG. 7B is a schematic view showing an assembly of FIG. 7A is in use.

Now referring to FIGS. 7A and 7B, wherein, with the front of the flat board (51) facing downward, the inclined surface (53) is placed toward the upper angular protruded bit (531) into the rectangular base channel (36) of the press plate (32), then the flat board (51) is secured in the screw hole (532) with the bolt (54) from the top of the flat board (51), so to define the inclination of a work surface (101). Whereas by adjusting the width positioning plate (50) in the rectangular base channel (36) can jointly determine the width of the inclined work surface (101), the width positioning plate (50) is also referred to as an inclined surface positioning plate.

As illustrated in FIGS. 6A and 6B, the depth positioning plate (60) includes a flat board (61) having at its top provided with a protruded bit (62). A through hole (621) is laterally provided at the center of the protruded bit (62) to receive insertion of a bolt (63) and to be locked with a nut (64). The depth positioning plate (60) is provided externally to the sidewall (38 or 38') of the standard holder (30). The nut (64) may be buried in a ditch defined by those two strips (372, 373) to lock up the bolt (63) inserted through the protruded bit (62). The depth positioning plate (60) can be adjusted in the side channel (371) to change the relative distance from the face of the flat board (61) to the face of the press plate (32) so to define the depth of the work surface (100). Where outside the side walls (38, 38') of the standard holder may be also scaled (381) to help achieve more accurate adjustment of the depth of the work surface.

For example, if an L-shape groove (201) is desired to be planed on a piece of wooden material (200), both of the width and the depth positioning plates must be adjusted. Wherein, the width positioning plate (50) is adjusted deepening on the preset value of the width of the groove (201) so such extent that the relative distance of the flat board (51) respectively to both side walls (38, 38') of the standard holder (30) is equal to that preset value. Meanwhile, the depth positioning plate (60) is adjusted so that the relative distance of the surface of the flat board (51) of the width positioning plate (50) is equal to a preset value of the depth of the groove (201), and then the surface of the flat board (51) is placed in flush with the side of the wooden material (200) to easily define the width of the L-shape groove (51) to continue planing for producing a depth for the groove (51) until the surface of the depth positioning plate (60) contacts a surface (202) of the wooden material (200) not requiring planing, where indicates that the L-shape groove (201) has reached its preset depth.

Figure 5A:
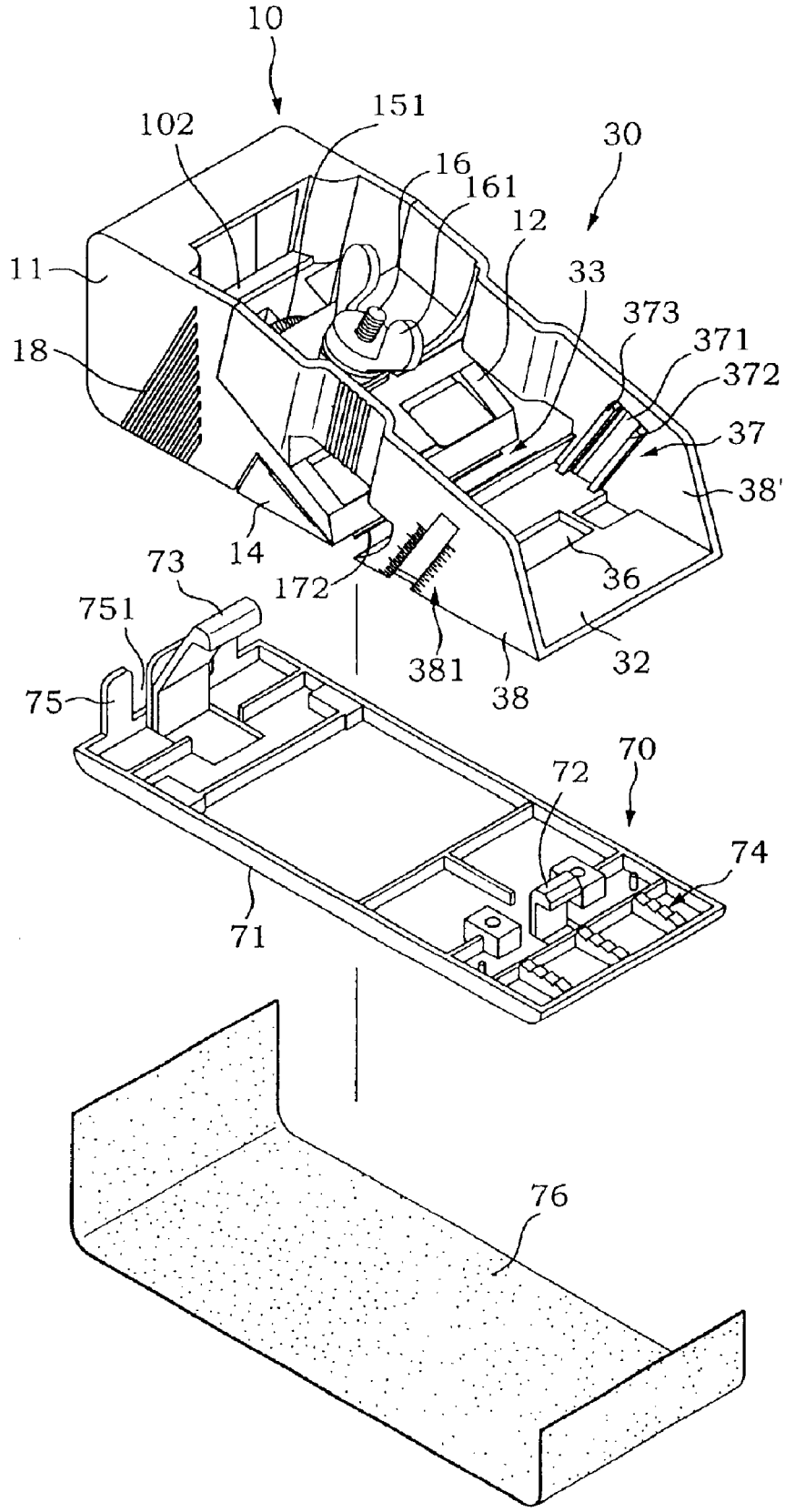
FIG. 5A is an exploded view showing the assembly taken from FIG. 2A, a sand paper holder and a sand paper.
Figure 5B:
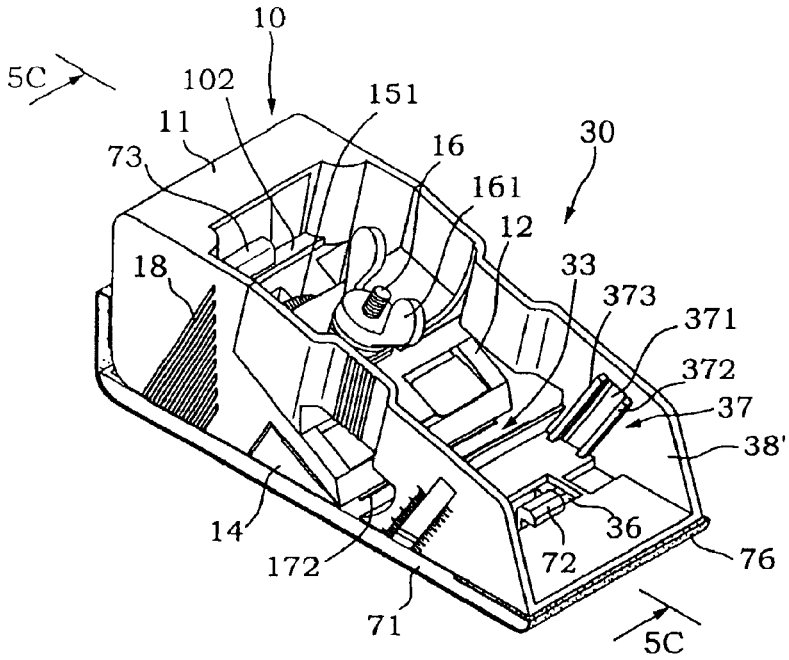
FIG. 5B is a view of as assembly taken from FIG. 5A.
Figure 5C:
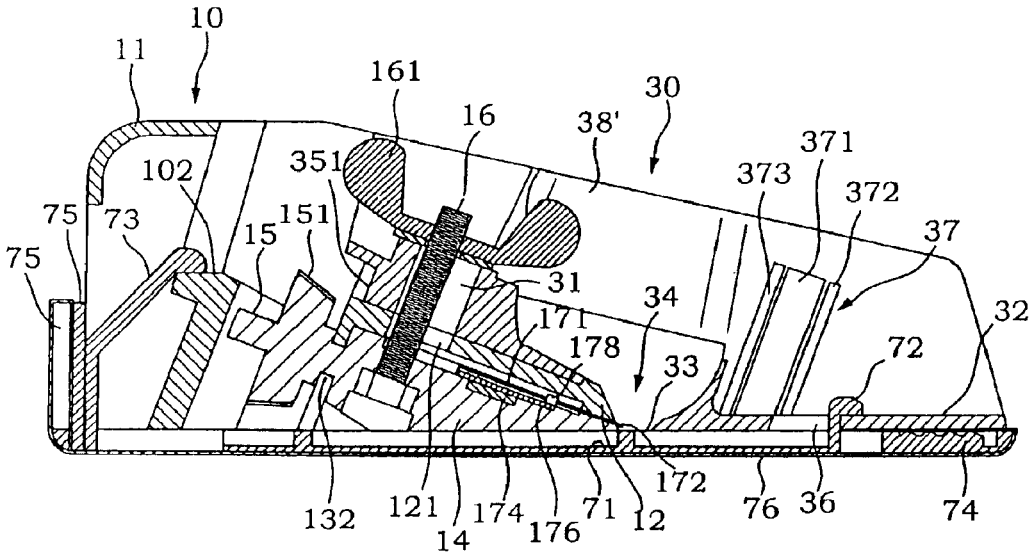
FIG. 5C is a sectional view taken from 5C—5C in FIG. 5B.

The sandpaper holder (70) as illustrated in FIGS. 5A, 5B and 5C, has a horizontal board (71), whereon a front hook (72) and a rear hook (83) are provided. A rough zone of resistance (74) is provided on the horizontal board (71) in front of the front hook (72), and multiple fixation boards (75) are provided at where behind the rear hook (73) arranged alternatively to form a slit (751) between any two abutted fixation boards (75). A sandpaper (76) is placed flat on the bottom of the sandpaper holder (70) with its front edge folded up and stacked on the resistance zone (74) and with its tail also folded up and stuffed in the slit (751). The front hook (72) hooks up the edge of the rectangular base channel (36) and the rear hook (73) hooks up the back (102) of the base holder (10) to clamp the sandpaper (76) in the resistance zone (74) between the horizontal plate (71) and the press plate (32) by preventing the sandpaper (76) from sliding on the resistance zone (74). A back ejection will be created when the rear hook (73) hooks up the basic holder (10) to squeeze the slip (751), thus to secure the tail of the sandpaper (76) and maintain the sandpaper (76) flush in position on the bottom of the sandpaper holder (70). Finally, by reciprocal moving the standard unit of the plane, the work surface is planed as desired.

It is to be noted that all the bolts and nuts used in the present invention can be forthwith turned by manual. Therefore, no hand tool is required.

I claim:

1. A carpenter's plane comprising:

a basic holder, comprised of a handle and a slope extending outward and downward from the lower edge of the front of the handle a blade holder space being formed between where below the slope and the handle; and a blade holder, secured in the blade holder space, having a blade insertion structure provided on top of the holder to receive insertion of a blade, the blade being restricted by and the blade edge normally exposed out of the blade holder and the slope wherein, an accessory holder is provided on top of the slope wherein, the rear of the holder being secured to the slope, a press plate being provided at the front of the holder in relation to the horizontal level of the blade edge, a distance being predetermined between the rear of the press plate and the blade edge to form a planing trough, and an open space for planings being provided over the planing trough wherein, a sandpaper holder is adapted to the bottom of the holder.

2. A combination of carpenter's plane as claimed in claim 1, wherein, the sandpaper holder is provided with a horizontal board, a front hook and a rear hook being provided on the horizontal board, a rough zone being provided before the front hook on the horizontal board, multiple fixation boards being provided behind the rear hook the front hook being hooked up to the edge of the rectangular base channel and the rear hook, to the back of the basic holder and both ends of the sandpaper holder, as well as between the basic holder and the sandpaper holder.

3. A combination of carpenter's plane essentially includes:

a basic holder, comprised of a handle and a slope extending outward and downward from the lower edge of the front of the handle; a blade holder space being formed between where below the slope and the handle; and a blade holder, secured in the blade holder space, having a blade insertion structure provided on top of the holder to receive insertion of a blade, the blade being restricted by and the blade edge normally exposed out of the blade holder and the slope wherein, an accessory holder is provided on top of the slope wherein, the accessory holder relates to a holder, the rear of the holder being secured to the slope, a press plate being provided at the front of the holder in relation to the horizontal level of the blade edge, a distance being predetermined between the rear of the press plate and the blade edge to form a planing trough, and an open space for planings being provided over the planing trough wherein, a rectangular base channel is provided on the press plate.

* * * * *